US010088209B2

(12) United States Patent
Kawai et al.

(10) Patent No.: US 10,088,209 B2
(45) Date of Patent: Oct. 2, 2018

(54) AIR CONDITIONER

(71) Applicant: Fujitsu General Limited, Kawasaki-shi (JP)

(72) Inventors: Keito Kawai, Kawasaki (JP); Hideya Tamura, Kawasaki (JP); Takahiro Matsunaga, Kawasaki (JP); Shinju Watanabe, Kawasaki (JP); Takashi Kimura, Kawasaki (JP); Kotaro Toya, Kawasaki (JP); Yasuhiro Oka, Kawasaki (JP); Ken Nakashima, Kawasaki (JP)

(73) Assignee: Fujitsu General Limited, Kawasaki-shi (JP)

( * ) Notice: Subject to any disclaimer, the term of this patent is extended or adjusted under 35 U.S.C. 154(b) by 569 days.

(21) Appl. No.: 13/733,738

(22) Filed: Jan. 3, 2013

(65) Prior Publication Data

US 2013/0227978 A1 Sep. 5, 2013

(30) Foreign Application Priority Data

Mar. 1, 2012 (JP) ..... 2012-045431

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01); *F25B 2313/007* (2013.01);
(Continued)

(58) Field of Classification Search
CPC ..... F25B 13/00; F25B 41/04; F25B 2313/02741; F25B 2400/075;
(Continued)

(56) References Cited

U.S. PATENT DOCUMENTS 5,490,399 A * 2/1996 Sada ..... F25B 13/00 62/160
7,222,491 B2 * 5/2007 Moriwaki ..... F04B 39/0207 62/117
(Continued)

FOREIGN PATENT DOCUMENTS

EP 1526341 A1 4/2005
JP 05-203275 8/1993
(Continued)

OTHER PUBLICATIONS

European Search Report issued in European Patent Application No. 13150020.9 dated May 7, 2013.
(Continued)

*Primary Examiner* — Jianying Atkisson
*Assistant Examiner* — Meraj A Shaikh
(74) *Attorney, Agent, or Firm* — Venable LLP; Michael A. Sartori; Laura G. Remus

(57) ABSTRACT

An air conditioner 1 of the embodiment of the present invention, when all compressors 21*a*-21*c* have been stopping for a given time or more, starts an air conditioning operation without performing pressure equalizing control in switch units 6*a*-6*d* with starting the operation of the air conditioner 1. Also, when the stopping time of all compressors 21*a*-21*c* is less than the given time, the air conditioner 1 performs the pressure equalizing control by controlling switch units 6*a*-6*d* with starting the operation of the air conditioner 1. In this case, when the stopping time reaches the given time during execution of the pressure equalizing processing control, the pressure equalizing processing control being executed is stopped and the air conditioning operation is started.

4 Claims, 6 Drawing Sheets

(52) U.S. Cl.
CPC . *F25B 2313/023* (2013.01); *F25B 2313/0253* (2013.01); *F25B 2313/0272* (2013.01); *F25B 2313/02743* (2013.01); *F25B 2400/075* (2013.01); *F25B 2500/26* (2013.01); *F25B 2600/01* (2013.01); *F25B 2700/2106* (2013.01)

(58) Field of Classification Search
CPC ..... F25B 2500/27; F25B 2600/0251; F25B 2313/025; F04B 39/0207; F04B 41/06
USPC ..... 62/510, 160, 192–196.1, 84
See application file for complete search history.

(56) References Cited

U.S. PATENT DOCUMENTS 7,937,960 B2 * 5/2011 Matsui ..... F24F 3/1411 236/44 A
2006/0213209 A1 * 9/2006 Tanaami ..... F24D 19/1054 62/238.6
2009/0165484 A1 * 7/2009 Matsui ..... F24F 3/1411 62/271
2011/0239672 A1 * 10/2011 Won ..... F04B 39/0207 62/193

FOREIGN PATENT DOCUMENTS

| | | | |
|---|---|---|---|
| JP | 10-089778 | A | 4/1998 |
| JP | 2005-140444 | A | 6/2005 |
| JP | 2006-017374 | A | 1/2006 |
| JP | 2010-164270 | A | 7/2010 |

OTHER PUBLICATIONS

Notification of Reasons for Refusal in Japanese Patent Application No. 2012-045431, dated Feb. 9, 2016.

* cited by examiner

*FIG. 3*

200 SWITCH UNIT OPERATION TABLE

| STATE OF INDOOR UNIT | | FIRST OPENING /CLOSING DEVICE | SECOND OPENING /CLOSING DEVICE | THIRD OPENING /CLOSING DEVICE | FOURTH OPENING /CLOSING DEVICE |
|---|---|---|---|---|---|
| HEATING OPERATION | NORMAL TIME | OPEN | CLOSE | OPEN | CLOSE |
| | PRESSURE INCREASE TIME | CLOSE | CLOSE | OPEN | CLOSE |
| COOLING OPERATION | NORMAL TIME | CLOSE | OPEN | CLOSE | OPEN |
| | PRESSURE REDUCTION TIME | CLOSE | CLOSE | CLOSE | OPEN |
| STOPPING TIME | | CLOSE | CLOSE | CLOSE | OPEN |

AIR CONDITIONER

CROSS-REFERENCE TO RELATED APPLICATIONS

The present application claims the benefit of priority of Japanese Patent Application No. 2012-045431, filed on Mar. 1, 2012, which is incorporated herein by reference.

BACKGROUND

Field of the Invention

The present invention relates to an air conditioner in which a plurality of indoor units are connected to at least one outdoor unit by refrigerant pipes and each can operate in a cooling operation mode and in a heating operation mode selectively.

Related Art

Conventionally, there is proposed an air conditioner of a so called cooling/heating free operation type in which a plurality of indoor units are connected to at least one outdoor unit by refrigerant pipes and each can operate in a cooling operation mode and in a heating operation mode selectively. For example, an air conditioner disclosed in the patent reference 1 includes an outdoor unit having a compressor, flow passage switching units, an outdoor heat exchanger and an outdoor expansion valve, three indoor units having an indoor heat exchanger and an indoor expansion valve, and a branch unit having a high pressure side indoor switch valve and a low pressure side indoor expansion valve, wherein these units are connected to each other by a high pressure gas pipe, a low pressure gas pipe and a liquid pipe to form the refrigerant circuit of the air conditioner.

The high pressure side indoor switch valve of the branch unit includes has one end connected to the high pressure pipe by a refrigerant pipe, with the other end connected to the indoor heat exchanger by a refrigerant pipe. The pressure side switch valve has one end connected to the low pressure pipe by a refrigerant pipe, with the other end connected to the indoor heat exchanger by a refrigerant pipe. By opening and closing these two kinds of indoor switch valves, the indoor heat exchanger and high pressure gas pipe can be made to communicate with each other, or, the indoor heat exchanger and low pressure gas pipe can be made to communicate with each other. In the former mutual communication, the indoor heat exchanger functions as a condenser to operate in a heating operation mode and, in the latter, the indoor heat exchanger functions as an evaporator to operate in a cooling operation mode. Therefore, by operating the respective indoor switch valves of the branch unit, the indoor units individually can operate in a heating operation mode or in a cooling operation mode selectively.

In the above air conditioner, when switching the indoor unit from the heating operation mode to the cooling operation mode, or when switching the indoor unit from the cooling operation mode to the heating operation mode, there is a fear that the refrigerant pressure of the refrigerant pipe connecting the indoor heat exchanger and branch unit can change suddenly to thereby cause the refrigerant to flow suddenly in the high pressure side indoor switch valve and low pressure side indoor switch. And, the sudden flow of the refrigerant in the high pressure side indoor switch valve and low pressure side indoor switch can cause a strange sound (refrigerant flow sound) and thus can cause a user to feel strange.

To solve such problem, in the above air conditioner, the branch unit includes a high pressure side bypass pipe connected parallel to the high pressure side indoor switch valve and having a high pressure side electromagnetic valve built therein and a low pressure side bypass pipe connected parallel to the low pressure side indoor switch valve and having a low pressure side electromagnetic valve built therein, while, using these elements, there is carried out uniform pressure control which will be described below. Specifically, when switching the indoor unit from the heating operation to the cooling operation, the high pressure side indoor switch valve and indoor expansion valve are closed and the low pressure side electromagnetic valve is opened, while leaving them in this state for a given time. Thus, the low pressure gas pipe side and indoor heat exchanger side of the low pressure side indoor switch valve are made to communicate with each other by the low pressure side bypass pipe, thereby reducing the refrigerant pressure of the indoor heat exchanger side of the low pressure side indoor switch valve. Therefore, when the low pressure side indoor switch valve is opened in order to start the cooling operation, it is possible to prevent the occurrence of the strange sound caused by the difference between the refrigerant pressures of the low pressure gas pipe side and indoor heat exchanger side of the low pressure side indoor switch valve.

When switching the indoor unit from the cooling operation to the heating operation, the low pressure side indoor switch valve and indoor expansion valve are closed and the high pressure side electromagnetic valve is opened, while leaving them in this state for a given time. Thus, the high pressure gas pipe side and indoor heat exchanger side of the high pressure side indoor switch valve are made to communicate with each other by the high pressure side bypass pipe, thereby increasing the refrigerant pressure of the indoor heat exchanger side of the high pressure side indoor switch valve. Therefore, when the high pressure side indoor switch valve is opened in order to start the heating operation, it is possible to prevent the occurrence of the strange sound caused by the difference between the refrigerant pressures of the high pressure gas pipe side and indoor heat exchanger side of the high pressure side indoor switch valve.

In the above air conditioner, during operation of the air conditioner, when a plurality of indoor units (in the air conditioner disclosed in the JP-A-H05-203275 (pages 3 to 4, and FIG. 1), three indoor units) are all stopped by an instruction from a user, an outdoor unit is also stopped, that is, a compressor provided in the outdoor unit is also stopped. From this state, also when the air conditioner starts to operate using any one of the indoor units according to an operation instruction from a user, there is operated pressure equalizing control similarly when the operation mode of this indoor unit is switched. Specifically, when the indoor unit operates in a cooling operation, the low pressure side electromagnetic valve is opened and is left opened for a given time, thereby reducing the refrigerant pressure of the indoor heat exchanger side of the low pressure side indoor switch valve. Also, for a heating operation, the high pressure side electromagnetic valve is opened and is left opened for a given time, thereby increasing the refrigerant pressure of the indoor heat exchanger side of the high pressure side indoor switch valve.

On the other hand, when a long time, for example, an hour or more has passed since the stop of the compressor, the refrigerant circuit of the air conditioner is equalized in pressure. In such pressure equalized state of the refrigerant circuit, when there is operated the pressure equalizing control in the indoor unit, the indoor unit cannot start to operate until the pressure equalizing control is ended, thereby raising a fear that the time necessary before the indoor unit starts to operate is longer than necessary and thus can impair the comfort of a user.

One or more embodiments of the present invention aims at solving the above problems and thus it is an object of the invention to provide an air conditioner which can carry out proper pressure equalizing control according to the state of a refrigerating cycle.

SUMMARY

In order to solve the above problems, One or more embodiments of the present invention provides an air conditioner comprises: at least one outdoor unit including a compressor, an outdoor heat exchanger and open-air temperature detectors for detecting the temperature of the open-air; a plurality of indoor units each including an indoor heat exchanger and indoor unit pressure reducing units; and, a plurality of switching units provided correspondingly to a plurality of indoor units for switching the direction of the flow of a refrigerant in the indoor heat exchanger. The outdoor unit and a plurality of switching units are connected together by a high pressure gas pipe and a low pressure gas pipe, a plurality of indoor units are connected to the at least one outdoor unit by a liquid pipe, and the mutually corresponding a plurality of indoor units and a plurality of switching units are connected together by refrigerant pipes. Also, each of the switching units includes pressure equalizing units which, according to an instruction from the corresponding indoor unit, equalize a pressure by increasing or reducing the refrigerant pressure of the indoor heat exchanger provided in the associated indoor unit. In the case that at least one indoor unit starts to operate when the time during which all of the compressors are stopping is a given time or more, the pressure equalizing units do not equalize the pressure. Also, in the case that at least one indoor unit starts to operate when the time during which all of the compressors are stopping is less than the given time, the pressure equalizing units equalize the pressure and, in the case that the time during which all of the compressors are stopping reaches the given time when the pressure equalizing units is equalizing the pressure, the pressure equalizing units stop equalizing the pressure.

According to one or more embodiments of the present invention as described above, when the passage time from the stop of all compressors is the given time or more, the pressure equalizing units do not equalize the pressure. Also, in the case that the time during which all of the compressors are stopping reaches the given time when the pressure equalizing units is equalizing the pressure, the pressure equalizing units stop equalizing the pressure. Therefore, since while all compressors are stopping, when the indoor unit starts to operate, the pressure equalizing units do not equalize the pressure unnecessarily. Therefore, the time necessary before the indoor unit starts to operate can be shortened, thereby impairing the comfort of a user.

BRIEF DESCRIPTION OF DRAWINGS

FIG. 3 is a switching unit operation table defining the operations of valves provided in the switching unit in the air conditioner as the embodiment of the present invention;

DETAILED DESCRIPTION

Hereinafter, an embodiment of the present invention will be described in detail based on the attached drawings. As the embodiment, an air conditioner of a so called cooling and heating free operation type will be described as an example in which three outdoor units and four indoor units are connected together by refrigerant pipes and each indoor unit can operate in a cooling operation and in a heating operation selectively. The present invention is not limited to the embodiment described below and may be variously modified without departing from the gist of the present invention.

Embodiment

Figure 1:
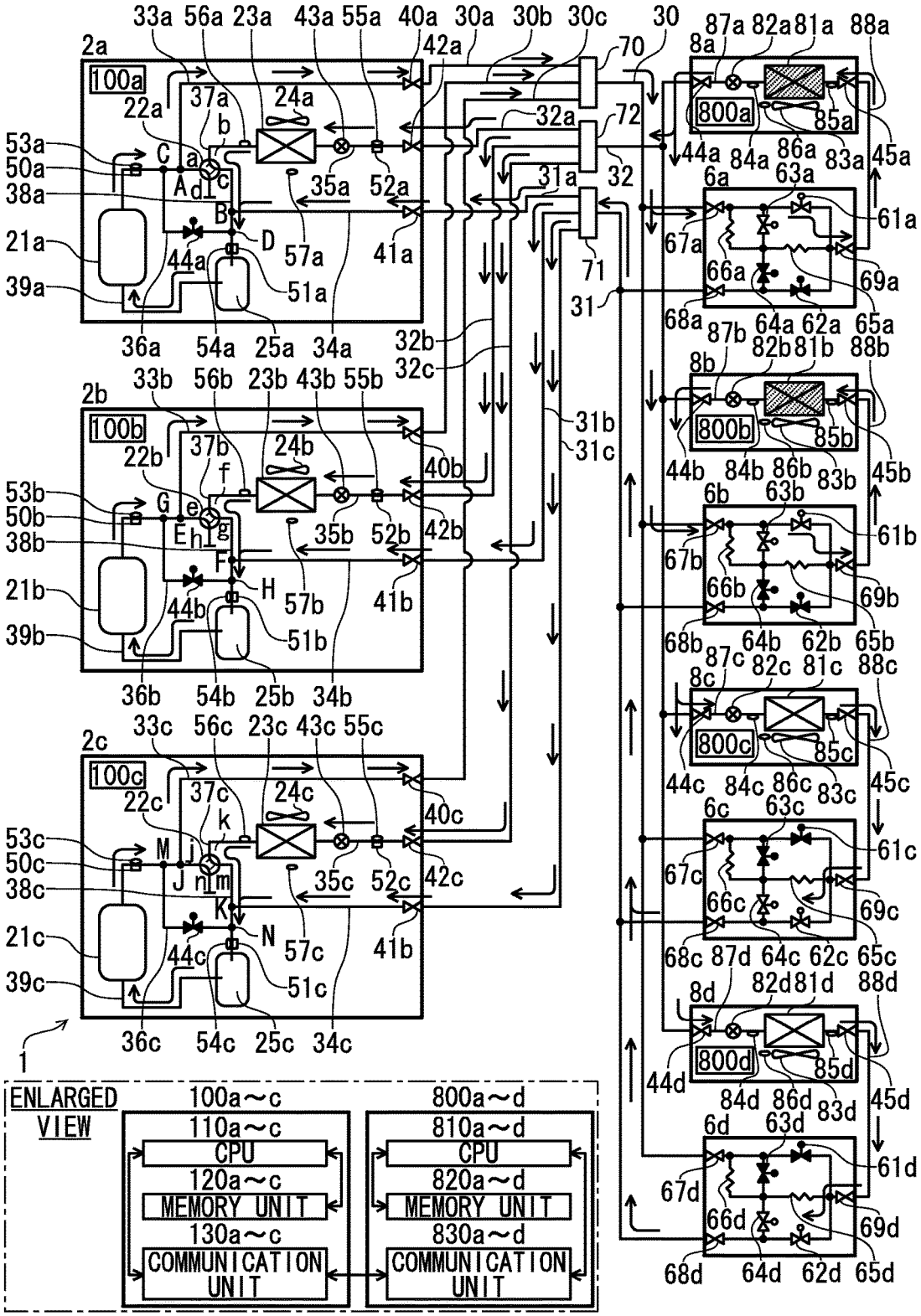
FIG. 1 is a refrigerant circuit diagram, of an air conditioner as an embodiment of the present invention, explaining the flow of the refrigerant when a cooling main operation is performed.

As shown in FIG. 1, an air conditioner 1 of this embodiment includes three outdoor units 2*a*-2*c*, four indoor units 8*a*-8*d*, four switching units 6*a*-6*d* and turn-out devices 70, 71, 72. The outdoor units 2*a*-2*c*, indoor units 8*a*-8*d*, switching units 6*a*-6*d* and turn-out devices 70, 71, 72 are connected together by a high pressure gas pipe 30, high pressure gas branch pipes 30*a*-30*c*, a low pressure gas pipe 31, low pressure branch pipes 31*a*-31*c*, a liquid pipe 32 and liquid branch pipes 32*a*-32*c*, thereby constituting the refrigerant circuit of the air conditioner 1.

In the air conditioner 1, by opening/closing and switching various kinds of valves provided in the outdoor units 2*a*-2*c* and switching units 6*a*-6*d*, there can be performed various air conditioning operations such as a heating operation (all indoor units operate in a heating operation), a heating-based operation (when the whole capacity required of indoor unit(s) operating in a heating operation exceeds the whole capacity required of indoor unit(s) operating in a cooling operation), a cooling operation (all indoor units operate in a cooling operation), and a cooling-based operation (when the whole capacity required of indoor unit(s) operating in a cooling operation exceeds the whole capacity required of indoor unit(s) operating in a heating operation).

FIG. 1 shows a refrigerant circuit when, of these air conditioning operations, the heating-based operation is being performed. Firstly, description will be given of the structures of the outdoor units 2*a*-2*c* with reference to FIG. 1, since the outdoor units 2*a*-2*c* are all the same in structure, in the following description, only the structure of the outdoor unit 2*a* will be described and thus the specific description of the outdoor units 2*b* and 2*c* will be omitted.

As shown in FIG. 1, the outdoor unit 2*a* includes a compressor 21*a*, a four-way valve 22*a*, an outdoor heat exchanger 23*a*, an outdoor fan 24*a*, an accumulator 25*a*, an outdoor unit high pressure gas pipe 33*a*, an outdoor unit low pressure gas pipe 34*a*, an outdoor unit liquid pipe 35*a*, a hot gas bypass pipe 36*a*, refrigerant pipes 37*a*, 38*a*, 39*a*, closing valves 40*a*, 41*a*, 42*a*, an outdoor expansion valve 43*a*, and a bypassing electromagnetic valve 44*a* serving as outdoor unit opening/closing units.

The compressor 21*a* is a capacity variable type compressor the operation capacity of which can be varied when driven by a motor (not shown) having a rotation number controllable by an inverter. The discharge side of the compressor 21*a* is connected to the closing valve 40*a* by the outdoor unit high pressure gas pipe 33*a*, while the suction side thereof is connected to the flow-out side of the accumulator 25*a* by the refrigerant pipe 39*a*. The flow-in side of the accumulator 25*a* is connected to the closing valve 41*a* by the outdoor unit low pressure gas pipe 34*a*.

The four-way valve 22 is used to switch the refrigerant flow direction and includes four ports a, b, c, d. To the port a, there is connected a refrigerant pipe which is connected to the outdoor unit high pressure gas pipe 33*a* at a connecting point A. The port b and outdoor heat exchanger 23*a* are connected together by the refrigerant pipe 37*a*. The refrigerant pipe 38*a* connected to the port c is connected to the outdoor unit low pressure gas pipe 34*a* at a connecting point B. Here, the port d is sealed.

The outdoor heat exchanger 23*a* is used to exchange heat between the refrigerant and the open-air taken into the outdoor unit 2*a* by the outdoor fan 24*a* (which will be discussed later). One end of the outdoor heat exchanger 23*a*, as described above, is connected to the port b of the four-way valve 22*a* by the refrigerant pipe 37*a*, with the other end connected to one port of the outdoor expansion valve 43*a* by a refrigerant pipe. Here, the other port of the outdoor expansion valve 43*a* is connected to the closing valve 42*a* by the outdoor unit liquid pipe 35*a*. The outdoor heat exchanger 23*a*, when the air conditioner 1 operates in a cooling/cooling-based operation, functions as a condenser and, for a heating/heating-base operation, functions as an evaporator.

The outdoor fan 24*a* is a resin-made propeller fan which is disposed near the outdoor heat exchanger 23*a*. When rotated by a fan motor (not shown), it takes the open-air into the outdoor unit 2*a* and, after heat exchange between the refrigerant and open-air in the outdoor heat exchanger 23*a*, it discharges the heat-exchanged open-air to the outside of the outdoor unit 2*a*.

The accumulator 25*a* has a flow-in side connected to the outdoor unit low pressure gas pipe 34*a*, with its flow-out side connected to the suction side of the compressor 21*a* by the refrigerant pipe 39*a*. The accumulator 25*a* divides a refrigerant flown therein to a gas refrigerant and a liquid refrigerant, and allows only the gas refrigerant to be sucked into the compressor 21*a*.

The hot gas bypass pipe 36*a* has one end connected to the outdoor unit high pressure gas pipe 33*a* at a connecting point C, with the other end connected to the outdoor unit low pressure gas pipe 34*a* at a connecting point D. The bypassing electromagnetic valve 44*a* is incorporated in the hot gas bypass pipe 36*a* and, by opening or closing the bypassing electromagnetic valve 44*a*, the refrigerant is allowed to flow in the hot gas bypass pipe 36*a* or is prevented from flowing therein.

Besides the above composing elements, the outdoor unit 2*a* includes various sensors. As shown in FIG. 1, between the connecting point C and the discharge opening of the compressor 21*a* in the outdoor unit high pressure gas pipe 33*a*, there are interposed a high pressure sensor 50*a* serving as high pressure detectors for detecting the discharge pressure of a refrigerant discharged from the compressor 21*a*, and a discharge temperature sensor 53*a* for detecting the temperature of a refrigerant discharged from the compressor 21*a*. Between the connecting point D and the flow-in opening of the accumulator 25*a* in the outdoor unit low pressure gas pipe 34*a*, there are interposed a low pressure sensor 51*a* serving as low pressure detectors for detecting the suction pressure of a refrigerant sucked into the compressor 21*a*, and a suction temperature sensor 54*a* for detecting the temperature of a refrigerant sucked into the compressor 21*a*. Between the outdoor expansion valve 43*a* and closing valve 42*a* in the outdoor unit liquid pipe 35*a*, there are interposed an intermediate pressure sensor 52*a* for detecting the pressure of a refrigerant flowing in the outdoor unit liquid pipe 35*a*, and a refrigerant temperature sensor 55*a* for detecting the temperature of a refrigerant flowing in the outdoor unit liquid pipe 35*a*.

On the refrigerant pipe 37*a*, there is provided a heat exchange temperature sensor 56*a* for detecting the temperature of a refrigerant flowing out from or into the outdoor heat exchanger 23*a*. Near the open-air suction opening (not shown) of the outdoor unit 2*a*, there is provided an open-air temperature sensor 57*a* serving as open-air temperature detectors for detecting the temperature of the open air flowing into the outdoor unit 2*a*, that is, the open-air temperature.

The outdoor unit 2*a* includes a controller 100*a*. The controller 100*a* is carried on a control substrate stored in an electric equipment box (not shown) of the outdoor unit 2*a*, and includes a CPU 110*a*, a memory 120*a* and a communication unit 130*a*. CPU 110*a* receives detection signals from the above sensors of the outdoor unit 2*a* and receives through the communication unit 130*a* control signals output from the indoor units 8*a*-8*d*. CPU 110*a*, according to the received detection signals and control signals, carries out various kinds of control relating to the operation of the outdoor unit 2*a* such as control of the rotations of the compressor 21*a* and outdoor fan 24*a*, control of the switching of the four-way valve 22*a* and control of the opening angle of the outdoor expansion valve 43*a*.

In addition to the above-described structure, various sensors are provided in the outdoor unit 2. As shown in FIG. 1, a high pressure sensor 50 that detects the pressure of the refrigerant discharged from the compressor 21 and a discharge temperature sensor 53 that detects the temperature of the refrigerant discharged from the compressor 21 are provided between the discharge side of the compressor 21 and the connection point P on the outdoor unit high pressure gas pipe 30*a*. A low pressure sensor 51 that detects the pressure of the refrigerant sucked into the compressor 21 and a sucking temperature sensor 54 that detects the temperature of the refrigerant sucked into the compressor 21 are provided between the sucking side of the compressor 21 and the connection point S on the outdoor unit low pressure gas pipe 31*a*. An intermediate pressure sensor 52 that detects the pressure of the refrigerant flowing through the outdoor unit fluid pipe 32*a* and a refrigerant temperature sensor 55 that detects the temperature of the refrigerant flowing through the outdoor unit fluid pipe 32*a* are provided between the connection point Q and the closing valve 43 on the outdoor unit fluid pipe 32*a*.

Although the structure of the outdoor unit 2*a* has been described above, the structures of the outdoor units 2*b* and 2*c* are the same as that of the outdoor unit 2*a* and, therefore, when the ends of numbers given to the composing elements (devices and members) of the outdoor unit 2*a* are changed from a to b or c, the thus obtained new designations stand for the composing elements of the outdoor units 2*b* and 2*c* corresponding to those of the outdoor unit 2*a*. However, in the case of the connecting points between the ports of the four-way valve and refrigerant pipes, signals differ between the outdoor unit 2*a* and outdoor units 2*b*, 2*c*. Correspondingly to the ports a, b, c, d of the four-way valve 22*a* of the outdoor unit 2*a*, the ports of the four-way valve 22*b* of the outdoor unit 2*b* are designated e, f, g, h and the ports of the four-way valve 22*c* of the outdoor unit 2*c* are designated j, k, m, n. Also, correspondingly to the connecting points A, B, C, D of the outdoor unit 2*a*, the connecting points of the outdoor unit 2*b* are designated E, F, G, H and the connecting points of the outdoor unit 2*c* are designated J, K, M, N.

Next, description will be given below of the structures of the four indoor units 8*a*-8*d* with reference to FIG. 1. Here, since the structures of the four indoor units 8*a*-8*d* are all the same, in the following description, only the structure of the indoor unit 8*a* will be described, while omitting the description of the structures of the remaining indoor units 8*b*-8*d*.

The indoor unit 8*a* includes an indoor heat exchanger 81*a*, an indoor expansion valve 82*a* serving as indoor unit pressure reducing units, an indoor fan 83*a*, refrigerant pipes 87*a*, 88*a*, and closing valves 44*a*, 45*a*. The indoor heat exchanger 81*a* has one end connected to one port of the indoor expansion valve 82*a* by a refrigerant pipe, with the other end connected to the closing valve 45*a* by a refrigerant pipe. The indoor heat exchanger 81*a*, when the indoor unit 8*a* operates in a cooling operation, functions as an evaporator and, when the indoor unit 8*a* operates in a heating operation, functions as a condenser.

The indoor expansion valve 82*a* has one port, as described above, connected to the indoor heat exchanger 81*a* by a refrigerant pipe, with the other port connected to one port of the closing valve 44*a* by the refrigerant pipes 87*a*. Here, one end of the refrigerant pipes 88*a* is connected to the other port of the closing valve 44*a*. The opening angle of the indoor expansion valve 82*a* is controlled according to a required cooling capacity when the indoor heat exchanger 81*a* functions as an evaporator, while it is controlled according to a required heating capacity when the indoor heat exchanger 81*a* functions as a condenser.

The indoor fan 83*a* is a resin-made cross-flow fan and, when rotated by a fan motor (not shown), sucks the indoor air into the indoor unit 8*a*; and, after heat is exchanged between the refrigerant and indoor air in the indoor heat exchanger 81*a*, it supplies the heat-exchanged air into a room.

Besides the above composing elements, the indoor unit 8*a* includes various sensors. On the refrigerant pipe existing on the indoor expansion valve 82*a* side of the indoor heat exchanger 81*a*, there is provided a refrigerant temperature sensor 84*a* for detecting the temperature of a refrigerant flowing into or flowing out from the indoor heat exchanger 81*a*. On the refrigerant pipe existing on the closing valve 45*a* side of the indoor heat exchanger 81*a*, there is provided a refrigerant temperature sensor 85*a* for detecting the temperature of a refrigerant flowing into or flowing out from the indoor heat exchanger 81*a*. Near the indoor air suction opening (not shown) of the indoor unit 8*a*, there is provided a room temperature sensor 86*a* for detecting the temperature of the indoor air flowing into the indoor unit 8*a*, that is, the indoor temperature.

The indoor unit 8*a* includes a controller 800*a*. The controller 800*a* is carried on a control substrate stored in the electric equipment box (not shown) of the indoor unit 8*a* and includes a CPU 810*a*, a memory 820*a* and a communication unit 830*a*. CPU 810*a* receives detection signals from the above sensors and also receives through the communication unit 830*a* control signals output from the outdoor units 2*a*-2*d*. CPU 810*a*, according to the received detection signals and control signals, carries out various kinds of control relating to the operation of the indoor unit 8*a* such as control of the rotation of the indoor fan 83*a* and control of the opening angle of the indoor expansion valve 82*a*.

The memory 820*a*, which is constituted of a ROM and a RAM, stores therein the control program of the indoor unit 8*a* and detection values corresponding to the detection signals from the sensors. The communication unit 830*a* is an interface which mediates communication between the indoor unit 8*a* and outdoor units 2*a*-2*c*.

Here, the controllers 100*a*-100*c* of the outdoor units 2*a*-2*c* and the controllers 800*a*-800*d* of the indoor units 8*a*-8*d* are connected together through the communication units 130*a*-130*c* and communication units 830*a*-830*d* such that they can communicate with each other.

Although description has been given above of the structure of the indoor unit 8*a*, the indoor units 8*b*-8*d* are the same in structure as the indoor unit 8*a* and, therefore, when the ends of numbers given to the composing elements (devices and members) of the indoor unit 8*a* are changed from a to b, c and d, the thus obtained new designations stand for the composing elements of the indoor units 8*b*-8*d* corresponding to those of the indoor unit 8*a*.

Figure 2:
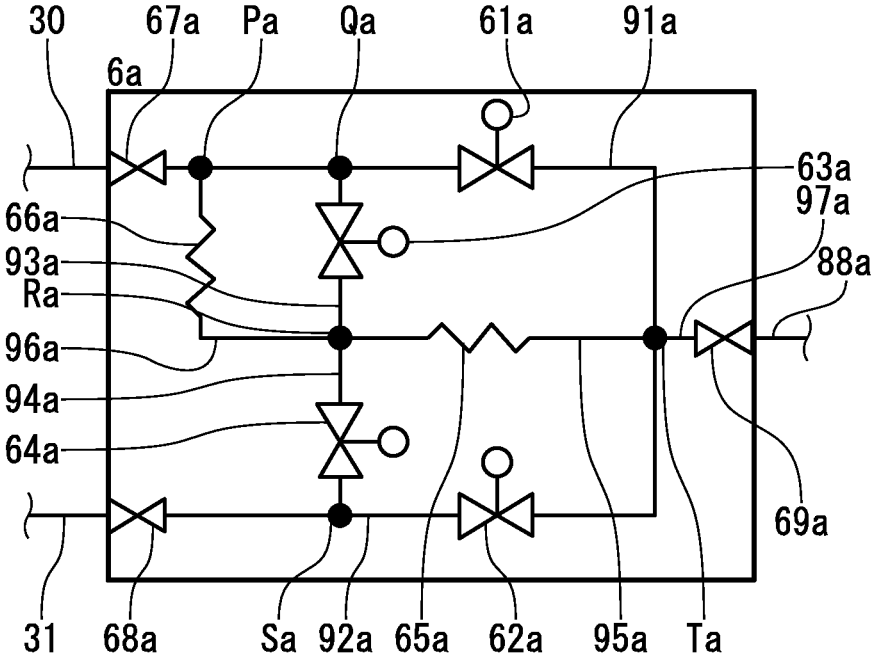
FIG. 2 is an explanatory view of the structure of a switching unit in the air conditioner as the embodiment of the present invention.

Next, description will be given below of the structures of the four switching units 6*a*-6*d* with reference to FIGS. 1 and 2. The air conditioner 1 includes four switching units 6*a*-6*d* respectively corresponding to the four indoor units 8*a*-8*d*. Here, since the switching units 6*a*-6*d* are all the same in structure, in the following description, only the structure of the switching unit 6*a* will be described, while omitting the description of the remaining switching units 6*b*-6*d*.

The switching unit 6*a* includes a first opening/closing device 61*a*, a second opening/closing device 62*a*, a third opening/closing device 63*a*, a fourth opening/closing device 64*a*, a first capillary tube 65*a* serving as flow amount limiting units, a second capillary tube 66*a*, closing valves 67*a*, 68*a*, 69*a*, a first branch pipe 91*a*, a second branch pipe 92*a*, a third branch pipe 93*a*, a fourth branch pipe 94*a*, a fifth branch pipe 95*a*, a bypass pipe 96*a* and a refrigerant pipe 97*a*.

The first branch pipe 91*a* has one end connected to one port of the closing valve 67*a*, while the second branch pipe 92*a* has one end connected to one port of the closing valve 68*a*. The other ends of the first and second branch pipes 91*a* and 92*a* are connected together at a connecting point Ta. One end of the refrigerant pipe 97*a* is connected to one port of the closing valve 69*a*, with the other end connected to the other ends of the first and second branch pipes 91*a* and 92*a* at the connecting point Ta. Here, the high pressure pipe 30 is connected to the other port of the closing valve 67*a*, the low pressure gas pipe 31 is connected to the other port of the closing valve 68*a*, and the other end of the refrigerant pipe 88*a* is connected to the other port of the closing valve 69*a*.

One end of the third branch pipe 93*a* is connected to the first branch pipe 91*a* at a connecting point Qa, while one end of the fourth pipe 94*a* is connected to the second branch pipe 92*a* at a connecting point Sa. The other ends of the third and fourth branch pipes 93*a* and 94*a* are connected together at a connecting point Ra.

The fifth branch pipe 95*a* has one end connected to the third and fourth branch pipes 93*a* and 94*a* at the connecting point Ra, with the other end connected to the first, second branch pipes 91*a*, 92*a* and refrigerant pipe 97*a* at a connecting point Ta. The bypass pipe 96*a* has one end connected to the first branch pipe 91 at a connecting point Pa, with the other end connected to the third, fourth and fifth branch pipes 93*a*, 94*a* and 95*a* at the connecting point Ra.

The first branch pipe 91*a* contains the first opening/closing device 61*a*, while the second branch pipe 92*a* contains the second opening/closing device 62*a*. The first and second opening/closing device 61*a* and 62*a* are each constituted of, for example, an electromagnetic valve. When the first opening/closing device 61*a* is opened and the second opening/closing device 62*a* is closed, the indoor heat exchanger 81*a* of the indoor unit 8*a* corresponding to the switching unit 6*a* is connected to the discharge side (high pressure gas pipe 30 side) of the compressor 21*a* and thus functions as a condenser. Also, the second opening/closing device 62*a* is opened and the first opening/closing device 61*a* is closed, the indoor heat exchanger 81*a* of the indoor unit 8*a* corresponding to the switching unit 6*a* is connected to the suction side (low pressure gas pipe 31 side) of the compressor 21*a* and thus functions as an evaporator.

The third opening/closing device 63*a* is incorporated in the third branch pipe 93*a*, the fourth opening/closing device 64*a* in the fourth branch pipe 94*a*, the first capillary tube 65*a* in the fifth branch pipe 95*a*, and the second capillary tube 66*a* in the bypass pipe 96*a*, respectively. The third and fourth opening/closing devices 63*a* and 64*a* are each constituted of, for example, an electromagnetic valve. When the third opening/closing device 63*a* is opened, the first branch pipe 91*a* and refrigerant pipe 97*a* are allowed to communicate with each other by the third and fifth branch pipes 93*a* and 95*a*. Also, when the fourth opening/closing device 64*a* is opened, the second branch pipe 92 and refrigerant pipe 97*a* are allowed to communicate with each other by the fourth and fifth branch pipes 94*a* and 95*a*.

Although description has been given above of the structure of the switching unit 6*a*, the switching units 6*b*-6*d* are the same in structure as the switching unit 6*a* and, therefore, when the ends of numbers given to the composing elements (devices and members) of the switching unit 6*a* are changed from a to b, c and d, the thus obtained new designations stand for the composing elements of the switching units 6*b*-8*d* corresponding to those of the switching unit 6*a*. Also, the third opening/closing devices 63*a*-63*d*, fourth opening/closing devices 64*a*-64*d*, first capillary tubes 65*a*-65*d*, third branch pipes 93*a*-93*d*, fourth branch pipes 94*a*-94*d* and fifth branch pipes 95*a*-95*d* constitute the pressure equalizing unit of the embodiment.

Next, description will be given below of the state of connection of the above-mentioned outdoor units 2*a*-2*c*, indoor units 8*a*-8*d* and switching units 6*a*-6*d* to the high pressure gas pipe 30, high pressure gas branch pipes 30*a*-30*c*, low pressure gas pipe 31, low pressure gas branch pipes 31*a*-31*c*, liquid pipe 32, liquid branch pipes 32*a*-32*c* and turn-out devices 70, 71, 72 with reference to FIG. 1. One-side ends of the high pressure gas branch pipes 30*a*-30*c* are connected to the closing valves 40*a*-40*c* of the outdoor units 2*a*-2*c*, with the other-side ends all connected to the turn-out device 70. One end of the high pressure gas pipe 30 is connected to this turn-out device 70, while the other end thereof branches and the branches are connected to the closing valves 67*a*-67*d* of the switching units 6*a*-6*d*.

One-side ends of the low pressure gas branch pipes 31*a*-31*c* are connected to the closing valves 41*a*-41*c* of the outdoor units 2*a*-2*c*, with the other-side ends all connected to the turn-out device 71. One end of the low pressure gas pipe 31 is connected to the turn-out device 71, while the other end thereof branches and the branches are connected to the closing valves 68*a*-68*d* of the switching units 6*a*-6*d*.

One-side ends of the liquid branch pipes 32*a*-32*c* are connected to the closing valves 42*a*-42*c* of the outdoor units 2*a*-2*c*, with the other-side ends all connected to the turn-out device 72. One end of the liquid pipe 32 is connected to the turn-out device 72, while the other end thereof branches and the branches are connected to the closing valves 44*a*-44*d* of the indoor units 8*a*-8*d*. The closing valves 45*a*-45*d* of the indoor units 8*a*-8*d* and the closing valves 69*a*-69*d* of the corresponding switching units 6*a*-6*d* are connected together by the refrigerant pipes 88*a*-88*d*.

The above-mentioned connection constitutes the refrigerant circuit of the air conditioner 1 and, when a refrigerant is allowed to flow in the refrigerant circuit, there is established a refrigerating cycle.

Next, description will be given below of the operation of the air conditioner 1 of this embodiment with reference to FIG. 1. Here, in the following description, in the case of the heat exchangers provided in the outdoor units 2*a*-2*c* and indoor units 8*a*-8*d*, when they function as condensers, they are hatched and, when they function as evaporators, they are outlined. Also, for the opening and closing states of the bypassing electromagnetic valves 44*a*-44*c* provided in the outdoor units 2*a*-2*c* and first opening/closing devices 61*a*-61*d*, second opening/closing devices 62*a*-62*d*, third opening/closing devices 63*a*-63*d* and fourth opening/closing devices 64*a*-64*d* provided in the switching units 6*a*-6*d*, when they are closed, they are shown in black and, when opened, they are outlined. Also, arrows show the flows of refrigerants.

As shown in FIG. 1, while, of the four indoor units 8*a*-8*d*, two 8*a* and 8*b* are operating in a heating operation and the remaining two 8*c* and 8*d* are operating in a cooling operation, when the whole capacity required of the two indoor units 8*a* and 8*b* operating in a heating operation exceeds the whole capacity required of the two indoor units 8*c* and 8*d* operating in a cooling operation, the air conditioner 1 carries out a heating-based operation. Here, in the following description, there is taken an example where, since the whole operation capacity required of the indoor units 8*a*-8*d* is large, all outdoor units 2*a*-2*c* are operated.

Specifically, CPU 110*a* of the outdoor unit 2*a* switches the four-way valve 22*a* to bring the ports a and d into mutual communication and the ports b and c into mutual communication. Thus, the refrigerant pipe 37*a* is connected through the refrigerant pipe 38*a* to the outdoor unit low pressure gas pipe 34*a* and the outdoor heat exchanger 23*a* is connected to the suction side of the compressor 21*a*, thereby allowing the outdoor heat exchanger 23*a* to function as an evaporator. Similarly, CPU 110*b* of the outdoor unit 2*b* switches the four-way valve 22*b* to bring the ports e and h into mutual communication and the ports f and g into mutual communication, thereby allowing the outdoor heat exchanger 23*b* to function as an evaporator. Also, CPU 110*c* of the outdoor unit 2*c* switches the four-way valve 22*c* to bring the ports j and n into mutual communication and the ports k and m into mutual communication, thereby allowing the outdoor heat exchanger 23*c* to function as an evaporator.

CPUs 810*a*, 810*b* of the indoor units 8*a*, 8*b* operating in a heading operation open the first opening/closing devices 61*a*, 61*b* and third opening/closing devices 63*a*, 63*b* of the corresponding switching units 6*a*, 6*b* to thereby allow a refrigerant to flow in the first branch pipes 91*a*, 91*b* and third branch pipes 93*a*, 93*b*, and close the second opening/closing devices 62*a*, 62*b* and fourth opening/closing devices 64*a*, 64*b* to thereby prevent a refrigerant from flowing in the second branch pipes 92*a*, 92*b* and fourth branch pipes 94*a*, 94*b*. This brings the closing valves 67*a*, 67*b* and closing valves 69*a*, 69*b* of the switching units 6*a*, 6*b* into mutual communication, whereby the indoor heat exchangers 81*a*, 81*b* of the indoor units 8*a*, 8*b* are allowed to function as condensers.

On the other hand, CPUs 810*c*, 810*d* of the indoor units 8*c*, 8*d* operating in a cooling operation close the first opening/closing devices 61*c*, 61*d* and third opening/closing devices 63*c*, 63*d* of the corresponding switching units 6*c*, 6*d* to thereby prevent a refrigerant from flowing in the first branch pipes 91*c*, 91*c* and third branch pipes 93*c*, 93*d*, and open the second opening/closing devices 62*c*, 62*d* and fourth opening/closing devices 64*c*, 64*d* to thereby allow a refrigerant to flow in the second branch pipes 92*c*, 92*c* and fourth branch pipes 94*c*, 94*d*. This brings the closing valves 68*c*, 68*d* and closing valves 69*c*, 69*d* of the switching units 6*c*, 6*d* into mutual communication, whereby the indoor heat exchangers 81*c*, 81*d* of the indoor units 8*c*, 8*d* are allowed to function as evaporators.

High pressure refrigerants discharged from the compressors 21*a*-21*c* flow in the outdoor unit high pressure gas pipes 33*a*-33*c* and then flow through the closing valves 40*a*-40*c* into the high pressure gas branch pipes 30*a*-30*c*. In this case, since the bypassing electromagnetic valves 44*a*-44*c* are closed, the refrigerants discharged from the compressors 21*a*-21*c* are prevented from flowing from the outdoor unit high pressure gas pipes 33*a*-33*c* through the hot gas bypass pipes 36*a*-36*c* into the outdoor unit low pressure gas pipes 34*a*-34*c*.

The refrigerant having flown into the high pressure gas branch pipes 30*a*-30*c* join together in the turn-out device 70, flow into the high pressure gas pipe 30 and then flow therefrom into the switching units 6*a*, 6*b*. After the refrigerants have flown into the switching units 6*a*, 6*b*, they flow in the first branch pipes 91*a*, 91*b* with the opened first opening/closing devices 61*a*, 61*b* contained therein, flow out from the switching units 6*a*, 6*b*, flow in the refrigerant pipes 88*a*, 88*b* and flow into the indoor units 8*a*, 8*b*. In this case, the amount of the refrigerants flowing from the first branch pipes 91*a*, 91*b* through the connecting points Pa, Pb into the bypass pipes 96*a*, 96*b*, due to the existence of the second capillary tubes 66*a*, 66, is very small when compared with the amount of the refrigerants flowing in the first branch pipes 91*a*, 91*b*. Also, since the third opening/closing devices 93*a*, 93*b* are opened and fourth opening/closing devices 94*a*, 94*b* are closed, the connecting points Qa, Qb are in communication with the connecting points Ta, TB. However, since the first capillary tubes 95*a*, 95*b* intervene between them, the amount of the refrigerant flowing from the first branch pipes 91*a*, 91*b* through the connecting points Qa, Qb into the third branch pipes 93*a*, 93*b* is very small when compared with the amount of the refrigerants flowing in the first branch pipes 91*a*, 91*b*.

After having flown into the indoor units 8*a*, 8*b*, the refrigerants flow into the indoor heat exchangers 81*a*, 81*b*, where they exchange heat with the indoor air to condense, thereby heating the inside of a room where the indoor units 8*a*, 8*b* are installed. After having flown out from the indoor heat exchangers 81*a*, 81*b*, the refrigerants pass through the indoor expansion valves 82*a*-82*c* incorporated in the refrigerant pipes 87*a*, 87*b*, where they are reduced in pressure, thereby providing intermediate pressure refrigerants. Here, CPUs 810*a*, 810*b* of the indoor units 8*a*, 8*b* obtains refrigerant super-cooled degrees in the indoor heat exchangers 81*a*, 81*b* functioning as condensers from refrigerant temperatures detected by the refrigerant temperature sensors 84*a*, 84*b* and high pressure saturation temperatures received from the outdoor units 2*a*-2*c* and, according to the thus obtained refrigerant super-cooled degrees, determine the opening angles of the indoor expansion valves 82*a*, 82*b*.

The refrigerant, which has passed through the indoor expansion valves 82*a*-82*c*, has flown in the refrigerant pipes 87*a*, 87*b* and has flown out from the indoor units 8*a*, 8*b*, flows into the liquid pipe 32. Part of this refrigerant flows into the turn-out device 72, while the remaining refrigerant flows through the liquid pipe 32 into the indoor units 8*c*, 8*d*. The refrigerant having flown into the turn-out device 72 branches into the liquid branch pipes 32*a*-32*b* and flows through the closing valves 42*a*-42*c* into the outdoor units 2*a*-2*c*.

The refrigerant having flown into the outdoor units 2*a*-2*c* is reduced in pressure while passing through the outdoor expansion valves 43*a*-43*c*, thereby providing the low pressure refrigerant; and, the low pressure refrigerant flows into the outdoor heat exchangers 23*a*-23*c*, where it exchanges heat with respect to the open air to thereby evaporate. After having flown out from the outdoor heat exchangers 23*a*-23*c*, the refrigerant flows through the four-way valves 22*a*-22*c* into the refrigerant pipes 38*a*-38*c* and then flows into the outdoor unit low pressure gas pipes 34*a*-34*c* from the connecting points B, F, K. The refrigerant, which has flown into the outdoor unit low pressure gas pipes 34*a*-34*c*, then flows in the refrigerant pipes 39*a*-39*c* through the accumulators 25*a*-25*c* and is sucked into the compressors 21*a*-21*c*, where it is compressed again.

Also, the intermediate pressure refrigerant, which has flown out from the indoor units 8*a*, 8*b* and has flown through the liquid pipe 32 into the indoor units 8*c*, 8*d*, is reduced in pressure while passing through the indoor expansion valves 82*c*, 82*d* incorporated in the refrigerant pipes 87*c*, 87*d*, thereby providing a low pressure refrigerant. The low pressure refrigerant then flows into the indoor heat exchangers 81*c*, 81*d*, where it exchanges heat with the indoor air to thereby evaporate. This cools the inside of a room where the indoor units 8*c*, 8*d* are installed. Here, CPUs 810*c*, 810*d* of the indoor units 8*c*, 8*d* obtain refrigerant superheated degrees in the indoor heat exchangers 81*c*, 81*d* functioning as evaporators from refrigerant temperatures detected by the refrigerant temperature sensors 84*c*, 84*d* and refrigerant temperatures detected by the refrigerant temperature sensors 85*c*, 85*d* and, according to the obtained refrigerant superheated degrees, determines the opening angles of the indoor expansion valves 82*c*, 82*d*.

After having flown out from the indoor heat exchangers 81*c*, 81*d*, the refrigerant flows through the refrigerant pipes 88*c*, 88*d* into the switching units 6*c*, 6*d*, where it flows through the connecting points Tc, Td in the second branch pipes 92*c*, 92*d* including the currently opened second opening/closing devices 62*c*, 62*d*. Then, the refrigerant flows out from the switching units 6*c*, 6*d* into the low pressure gas pipe 31. In this case, the amount of refrigerants, which flow from the connecting points Tc, Td into the fifth branch pipes 95*c*, 95*d* and flow through the connecting points Rc, Rd into the fourth branch pipes 94*c*, 94*d*, is very small because the first capillary tubes 65*a*, 65*b* are incorporated in the fifth branch pipes 95*c*, 95*d*. Also, since the refrigerant pressure in the connecting points Pc, Pd is higher than the refrigerant pressure in the connecting points Rc, Rd, the refrigerant is prevented from flowing from the connecting points Rc, Rd to the bypass pipes 96*c*, 96*d*.

After having flown into the low pressure gas pipe 31, the refrigerant flows into the turn-out device 71 and braches from the turn-out device 71 into the low pressure gas branch pipes 31*a*-31*c*. The refrigerant, which has flown from the low pressure gas branch pipes 31*a*-31*c* into the outdoor units 2a-2c, flows from the outdoor unit low pressure gas pipes 34a-34c through the connecting points B, F, F and accumulators 25a-25c into the refrigerant pipes 39a-39c; and, it is then sucked into the compressors 21a-21c, where it is compressed again.

Next, description will be given below of a control for pressure equalizing control to be performed by the air conditioner 1 of this embodiment with reference to FIGS. 1 to 5. In the memorys 820a-820d of the controllers 800a-800d of the indoor units 8a-8d, there is previously stored a switching unit operation table 200 shown in FIG. 3. This switching unit operation table 200 defines the opened or closed states of the valves of the switching units 6a-6d corresponding to the indoor units 8a-8d according to the operation states of the indoor units 8a-8d.

The items of the states of the indoor units are classified to a state where the indoor units 8a-8d are operating in a heating operation, a state where they are operating in a cooling operation, and a state where they are stopping. In the heating operation, when a normal heating operation is being performed, it is defined as a normal time, when a cooling operation is switched to a heating operation or a heating operation is started from the stopping state, it is defined as a pressure increase time. Also, in the cooling operation, when a normal cooling operation is being performed, it is defined as a normal time, when a heating operation is switched to a cooling operation or a cooling operation is started from the stopping state, it is defined as a pressure reduction time.

In the switching unit operation table 200, in the normal time in the heating operation, the first opening/closing devices 61a-61d and third opening/closing devices 63a-63d are opened, while the second opening/closing devices 62a-62d and fourth opening/closing devices 64a-64d are closed. In the pressure increase time, only the third opening/closing devices 63a-63d are opened, while the first opening/closing devices 61a-61d, second opening/closing devices 62a-62d and fourth opening/closing devices 64a-64d are closed.

In the normal time in the cooling operation, the second opening/closing devices 62a-62d and fourth opening/closing devices 64a-64d are opened, while the first opening/closing devices 61a-61d and third opening/closing devices 63a-63d are closed. In the pressure reduction time, only the fourth opening/closing devices 64a-64d are opened, while the first opening/closing devices 61a-61d, second opening/closing devices 62a-62d and third opening/closing devices 63a-63d are closed. Under stopping, similarly to the pressure reduction time in the cooling operation, only the fourth opening/closing devices 64a-64d are opened, while the first opening/closing devices 61a-61d, second opening/closing devices 62a-62d and third opening/closing devices 63a-63d are closed.

Next, description will be given below of control of the valves of the switching units 6a-6d using this switching unit operation table 200. Like the indoor units 8a, 8b shown in FIG. 1, in indoor units operating in a heating operation, CPUs 810a, 810b, while referring to the normal time item of the heating operation of the switching unit operation table 200, open the first opening/closing devices 61a-61d and third opening/closing devices 63a-63d, whereby, as described above, a refrigerant having flown from the high pressure gas pipe 30 into the switching units 6a, 6b is allowed to flow into the indoor heat exchangers 81a, 81b of the indoor units 8a, 8b to cause the indoor heat exchangers 81a, 81b to function as condensers.

Also, like the indoor units 8c, 8d shown in FIG. 1, in indoor units operating in a cooling operation, CPUs 810c, 810d, while referring to the normal time item of the cooling operation of the switching unit operation table 200, open the second opening/closing devices 62a-62d and fourth opening/closing devices 64a-64d, whereby, as described above, a refrigerant is allowed to flow from the liquid pipe 32 into the indoor heat exchangers 81c, 81d of the indoor units 8c, 8d to cause the indoor heat exchangers 81c, 81d to function as evaporators.

In the indoor units 8a-8d, when switching a heating operation to a cooling operation or when switching a cooling operation to a heating operation (which, hereinafter, will be described as when switching an operation mode, except for necessary cases), or when starting a cooling operation or a heating operation from the stopping state (which, hereinafter will be described as when starting an operation, except for necessary cases), CPUs 810a-810d of the controllers 800a-800d, while referring to the switching unit operation table 220, control the valves of the switching units 6a-6d to perform pressure equalizing control which will be described below.

For example, when switching the indoor unit 8a operating in a heating operation to a cooling operation or when driving the stopping indoor unit 8a to start a cooling operation, CPU 810a, while referring to the switching unit operation table 220, closes the first, second and third opening/closing devices 61a, 62a and 63a, and opens only the fourth opening/closing device 64a. Also, CPU 810a closes the indoor expansion valve 82a fully.

The reason why only the fourth opening/closing device 64a is opened in the above operation is as follows. That is, when the indoor unit 8a is operating in a heating operation or is stopping, the refrigerant pressure on the indoor unit 8a side (connecting point Ta side) of the closed second opening/closing device 62a, that is, the refrigerant pressure in the indoor heat exchanger 81a is higher than the low pressure gas pipe 31 side (connecting point Sa side) of the second opening/closing device 62a. In this state, when the second opening/closing device 62a is opened in order to switch the operation mode to a cooling operation or to start a cooling operation, there is a fear that the pressure difference between the two ends of the second opening/closing device 62a can cause the refrigerant to gush in the second opening/closing device 62a, thereby generating noises.

In view of this, when switching the indoor unit 8a from a heating operation to a cooling operation or driving it to start a cooling operation from its stopping state, firstly, only the fourth opening/closing device 64a is opened. Consequently, the connecting points Sa and Ta are allowed to communicate with each other by the fourth and fifth branch pipes 94a and 95a, whereby the refrigerant pressure in the connecting point Ta is caused to decrease (reduce) gradually by the first capillary tube 65a.

CPU 810a continues the state of only the fourth opening/closing device 64a being opened for a given pressure equalizing time (for example, 10 minutes), thereby controlling the pressure difference between the two ends of the second opening/closing device 62a to be equal to a given value (for example, 0.3 MPa) or less. Here, the given value of the pressure difference is previously obtained by a test or the like and is previously confirmed that it can prevent the refrigerant from gushing. Also, the pressure equalizing time is previously obtained by a test or the like and is stored in the memory 820a; and, it is the time necessary for the pressure difference between the two ends of the second opening/closing device 62*a* to reduce down to the given value or lower when only the fourth opening/closing device 64*a* is opened.

CPU 810*a*, after passage of the pressure equalizing time, opens the second opening/closing device 62*a* and opens the indoor expansion valve 82*a* at an opening angle corresponding to a required operation capacity. Under the above opening/closing control of the fourth opening/closing devices 64*a* and second opening/closing devices 62*a* is controlled as mentioned above, since the pressure difference between the two ends of the second opening/closing device 62*a* is the given value or lower when opening the second opening/closing device 62*a*, even when the second opening/closing device 62*a* is opened, the refrigerant is prevented from gushing, thereby being able to reduce the generation of noises caused by the gush of the refrigerant in the second opening/closing device 62*a*. Here, pressure equalizing control, which is performed when switching an indoor unit from a heating operation to a cooling operation or when driving it to start a cooling operation from its stopping state, is called pressure reduction control in the following description.

Also, for example, when switching the indoor unit 8*c* from a cooling operation to a heating operation or when driving it to start a heating operation from its stopping state, CPU 810*c*, while referring to the item of the pressure increasing time of the heating operation in the switching unit operation table 200, closes the first, second and fourth opening/closing devices 61*c*, 62*c* and 64*c*, while opening only the third opening/closing device 63*c*. Also, CPU 810*c* closes the indoor expansion valve 82*c* fully.

The reason why only the third opening/closing device 63*c* is opened in the above operation is as follows. That is, while the indoor unit 8*c* is operating in a cooling operation or is stopping, the refrigerant pressure on the indoor unit 8*a* side (connecting point Tc side) of the closed first opening/closing device 61*c*, that is, the refrigerant pressure in the indoor heat exchanger 81*c* is lower than the refrigerant pressure on the high pressure gas pipe 30 side (connecting point Qc side) of the closed first opening/closing device 61*c*. In this state, when the first opening/closing device 61*c* is opened in order to switch its operation mode to a heating operation or to start a heating operation, there is a fear that the pressure difference between the two ends of the first opening/closing device 61*c* can cause the refrigerant to gush in the closed first opening/closing device 61*c*, thereby generating noises.

Thus, when switching the indoor unit 8*c* from a cooling operation to a heating operation or when driving it to start a heating operation from its stopping state, firstly, only the third opening/closing device 63*c* is opened. This allows the third and fifth branch pipes 93*c* and 95*c* to bring the connecting points Qc and TC into mutual communication, whereby the refrigerant pressure at the connecting point Tc is gradually raised (increased) by the first capillary tube 65*c*.

CPU 810*c* continues the state of only the third opening/closing device 63*c* being opened for a uniform pressure time (for example, for ten minutes) to thereby control the pressure difference between the two ends of the first opening/closing device 61*c* to be a given value (for example, 0.3 MPa) or less. Here, the given value of the pressure difference is determined similarly to the case where the indoor unit 8*a* is switched from a heating operation to a cooling operation and is previously confirmed that it can prevent the refrigerant from gushing. Also, the above pressure equalizing time is previously obtained by a test or the like and is stored in the memory 820; and, it is a time necessary for the pressure difference between the two ends of the first opening/closing device 61*c* to decrease down to the given value or less.

CPU 810*c*, after passage of the pressure equalizing time, opens the first opening/closing device 61*c* and opens the indoor expansion valve 82*c* at an opening angle corresponding to an operation capacity required. Under the above opening/closing control of the third and first opening/closing devices 63*c* and 61*c* of the switching unit 6*c*, since the pressure difference between the two ends of the first opening/closing device 61*c* is the given value or less when opening the first opening/closing device 61*c*, even when the first opening/closing device 61*c* is opened, the refrigerant is prevented from gushing, thereby being able to reduce the generation of noises caused by the refrigerant gushing in the first opening/closing device 61*c*. Here, pressure equalizing control, which is performed when switching an indoor unit from a cooling operation to a heating operation or when driving it to start a heating operation from its stopping state, is called pressure increase control in the following description.

As described above, in the indoor units 8*a*-8*d*, when switching an operation mode or starting an operation, by carrying out the pressure increase control or pressure reduction control in the corresponding switching units 6*a*-6*d*, the operation mode of the indoor units 8*a*-8*d* can be switched while reducing the generation of noises caused by the pressure difference between the two ends of the first opening/closing devices 61*a*-61*d* and second opening/closing devices 62*a*-62*d*.

Next, using FIGS. 1 to 5, description will be given below of the pressure equalizing control to be performed when an operation is started in any one of indoor units 8*a*-8*d* while the compressors 21*a*-21*d* are all stopping. Here, in the following description, there is taken an example where, while the air conditioner 1 is operating in a heating-based operation shown in FIG. 1, the indoor units 8*a*-8*d* are all caused to stop at certain time according to the setting of a timer by a user and, thereafter, the indoor unit 8*a* starts its previous operation mode, namely, a heating operation according to an operation start instruction from the user. In the following description, of the outdoor units 2*a*-2*c*, the outdoor unit 2*a* serves as a parent unit.

Figure 4:
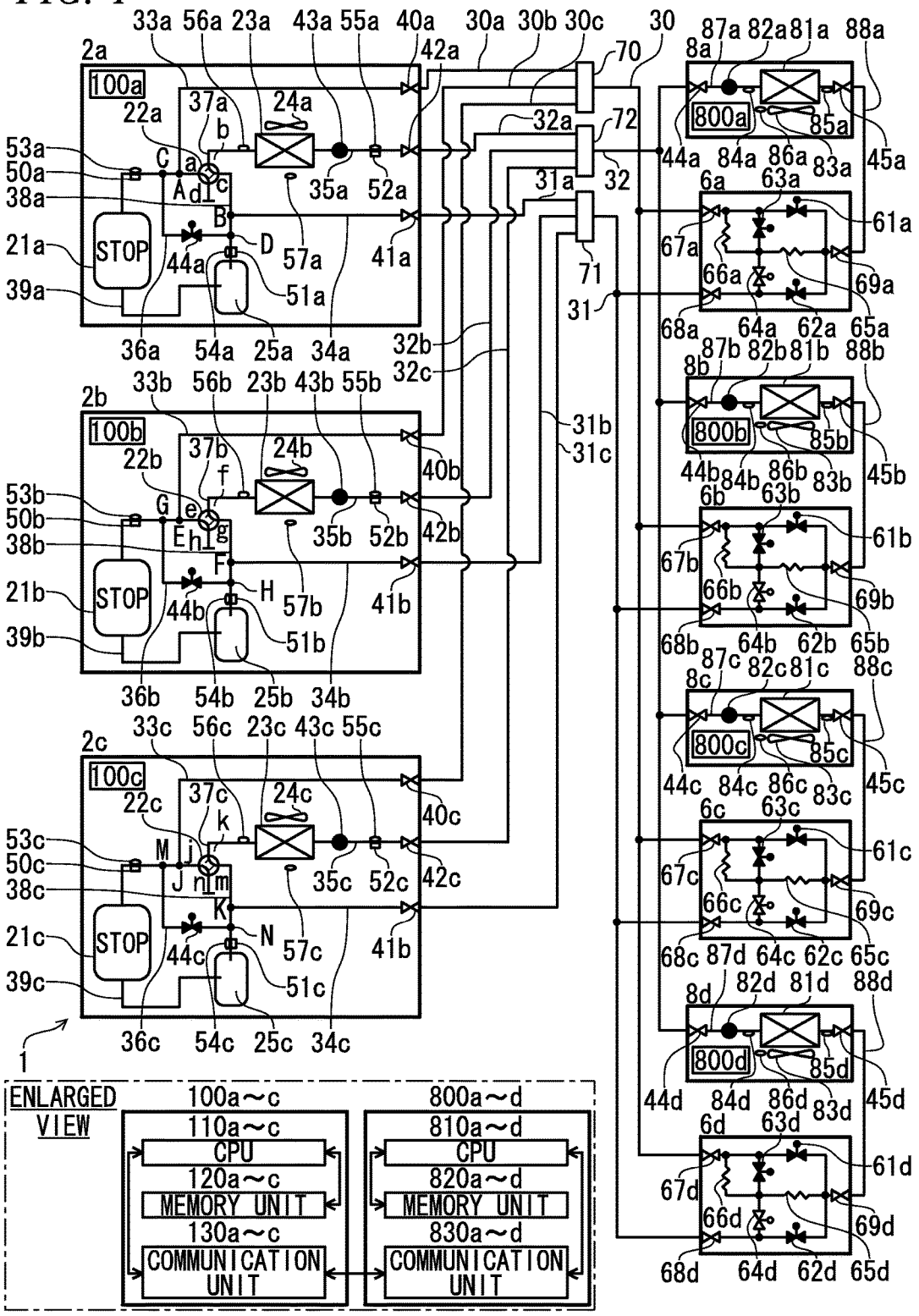
FIG. 4 is a refrigerant circuit diagram while all compressors are stopping in the air conditioner as the embodiment of the present invention.
Figure 5:
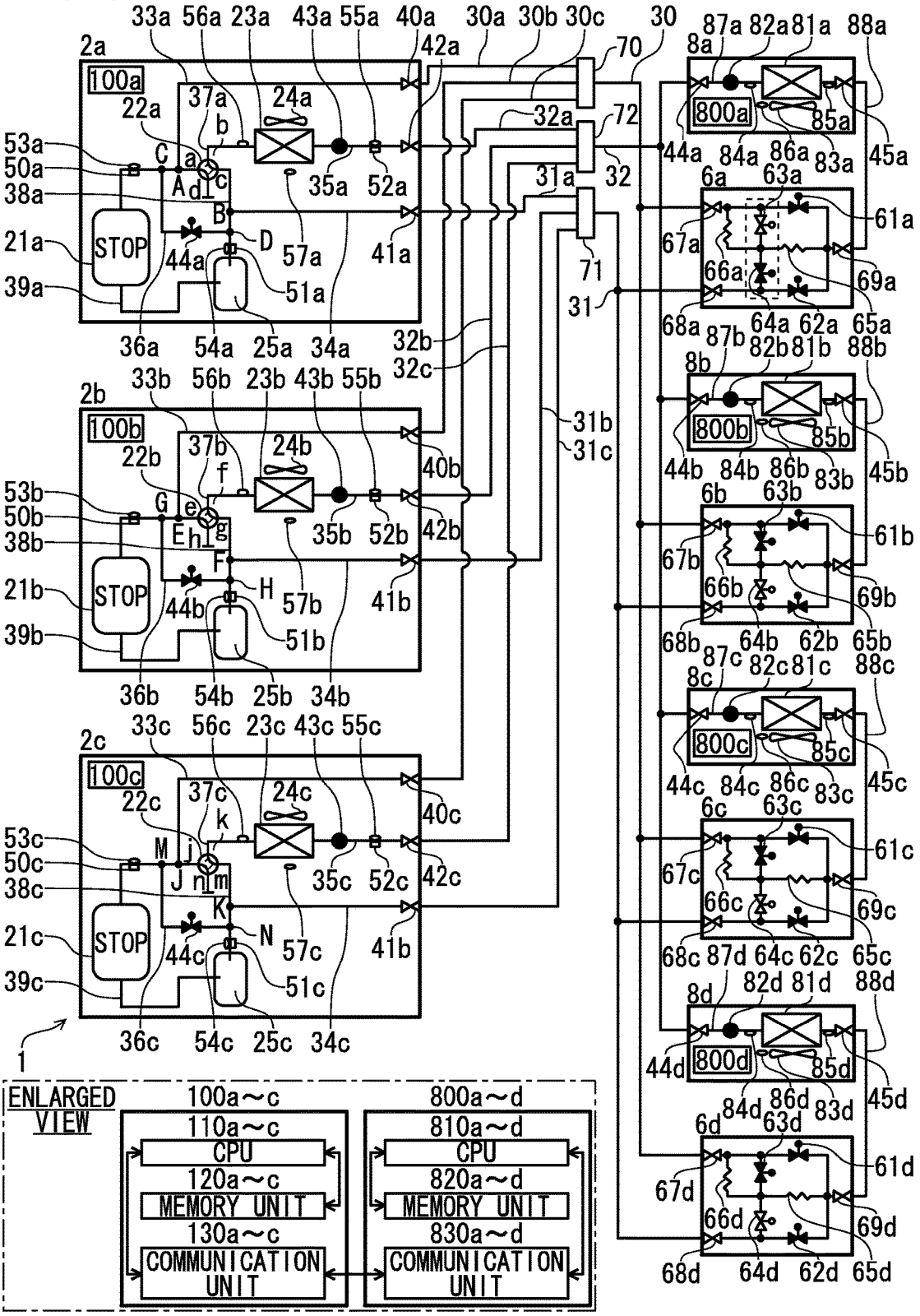
FIG. 5 is a refrigerant circuit diagram when an equalization of the pressure is performed in the air conditioner as the embodiment of the present invention.

The composing elements of a refrigerant circuit shown in FIGS. 4 and 5 are the same as those shown in FIG. 1 and thus the detailed description of FIGS. 4 and 5 is omitted. Also, in FIGS. 4 and 5, similarly to FIG. 1, for the opened and closed states of the bypassing electromagnetic valves 44*a*-44*c*, first opening/closing devices 61*a*-61*d*, second opening/closing devices 62*a*-62*d*, third opening/closing devices 63*a*-63*d* and fourth opening/closing devices 64*a*-64*d*, they are shown in black when closed and they are outlined when opened; and, the outdoor expansion valves 43*a*-43*d* and indoor expansion valves 82*a*-82*d* are also shown in black because they are all closed.

In a memory 120*a* included in the controller 100*a* of the outdoor unit 2*a* serving as a parent unit, there is stored a stop time previously set by a user for stopping the indoor units 8*a*-8*d* all together. CPU 110*a* of the controller 100*a*, when the current time reaches the stop time stored in the memory 120*a*, stops the compressor 21*a* and closes the outdoor expansion valve 43*a* fully. Also, it instructs the other outdoor units 2*b* and 2*c* to stop their operations. On receiving a stop instruction, CPUs 110*b* and 110*c* of the outdoor units 2*b* and 2*c* stop the compressors 21*b* and 21*c* and close the outdoor expansion valves 43*b* and 43*c* fully.

Also, CPU 110*a* instructs all indoor units 8*a*-8*d* to stop their operations. On receiving a stop instruction, CPUs 810*a*-810*d* of controllers 800*a*-800*d* of the indoor units 8*a*-8*d* close the indoor expansion valves 82*a*-82*d* and stop the indoor fans 85*a*-85*d*. CPUs 810*a*-810*d*, while referring to the item of the stopping of the switching unit operation table 200 stored in the memorys 820*a*-820*d*, operate the valves of the switching units 6*a*-6*d* corresponding to the indoor units 8*a*-8*d*.

Specifically, the first, second and third opening/closing devices 61*a*-61*d*, 62*a*-62*d* and 63*a*-63*d* are closed respectively to thereby prevent a refrigerant from flowing in the first, second and third branch pipes 91*a*-91*d*, 92*a*-92*d* and 93*a*-93*d*, while the fourth opening/closing devices 64*a*-64*d* are opened to thereby allow a refrigerant to flow in the fourth branch pipes 94*a*-94*d*.

The above operation of the various valves of the outdoor units 2*a*-2*d*, indoor units 8*a*-8*d* and switching units 6*a*-6*d* allows the refrigerant circuit of the air conditioner 1 to provide a state shown in FIG. 4.

While the compressors 21*a*-21*d* are all stopping and the air conditioner 1 is stopping its operation, when the fourth opening/closing devices 64*a*-64*d* are opened, in the switching units 6*a*-6*d*, the connecting points Pa-Pd and Sa-Sd are allowed to communicate with each other by the bypass pipes 96*a*-96*d* and fourth branch pipes 94*a*-94*d*. Also, the connecting points Sa-Sd and Ta-Td are allowed to communicate with each other by the fourth and fifth branch pipes 94*a*-94*d* and 95*a*-95*d*.

Consequently, the refrigerant pressure in the connecting points Pa-Pd of the switching units 6*a*-6*d* reduces gradually, whereby the pressure difference between the refrigerant pressures in the connecting points Pa-Pd and Ta-Td decreases gradually, that is, the pressure difference between the two ends of the first opening/closing devices 61*a*-61*d* decreases gradually. Also, the refrigerant pressure in the connecting points Sa-Sd rises (increases) gradually, whereby the pressure difference between the refrigerant pressures in the connecting points Sa-Sd and Ta-Td decreases gradually, that is, the pressure difference between the two ends of the second opening/closing devices 62*a*-62*d* decreases gradually.

On the other hand, when the compressors 21*a*-21*d* are all caused to stop, CPU 110*a* starts to measure the passage time from the stop of all compressors 21*a*-21*d*. The memory 120*a* of the controller 100*a* previously stores a given time (for example, an hour) necessary for the pressure difference between the two ends of the first and second opening/closing devices 61*a*-61*d* and 62*a*-62*d* to decrease down to a given value (for example, 0.3 MPa) or less while, as described above, the air conditioner 1 is stopping with only the fourth opening/closing devices 64*a*-64*d* opened. Depending on whether the passage time from the stop of the compressors 21*a*-21*d* reaches the given time or more or not, CPU 110*a* executes the different processing for the pressure equalizing when the air conditioner 1 starts to operate again.

Here, the above given value is a value previously obtained by a test or the like and, when the pressure difference between the two ends of the first and second opening/closing devices 61*a*-61*d* and 62*a*-62*d* is the given value or less, it is the pressure difference confirmed to be able to prevent the generation of noises caused by the refrigerant gushing in these devices. The above given time is also the time previously obtained by a test or the like and expressing the time necessary for the pressure difference between the two ends of the first and second opening/closing devices 61*a*-61*d* and 62*a*-62*d* to decrease down to a given value or less.

Next, description will be given below of specific operations when the air conditioner 1 starts with reference to a case where the passage time from the stop of all compressors 21*a*-21*c* is a given time or more and a case where it is not.

[Where the passage time from the stop of all compressors 21*a*-21*c* is a given time or more]

The air conditioner 1 is operating in a heating-based operation according to the refrigerant circuit shown in FIG. 1, for example, the stop time for stopping the indoor units 8*a*-8*d* all together is set for 21:00 by a user's timer setting and, on receiving an operation start instruction from the user, the indoor unit 8*a* starts a heating operation at 8:00 next day. At 21:00, CPU 110*a* instructs the indoor units 8*a*-8*d* and outdoor units 2*b*, 2*c* to stop their operations, and stops the compressor 21*a* to close the outdoor expansion valve 43*a* fully.

On receiving a stop instruction, CPUs 110*b* and 110*c* of the outdoor units 2*b* and 2*c* stop the compressors 21*b* and 21*c*, close the outdoor expansion valves 43*b* and 43*c*, and notify the outdoor unit 2*a* that they have stopped their operations. On receiving stop instruction, the indoor units 8*a*-8*d* close the indoor expansion valves 82*a*-82*d* fully and, in their corresponding switching units 6*a*-6*d*, the first, second and third opening/closing devices 61*a*-61*d*, 62*a*-62*d* and 63*a*-63*d* are closed respectively, while the fourth opening/closing devices 64*a*-64*d* are opened.

Under the above operation of the various valves of the outdoor units 2*a*-2*d*, indoor units 8*a*-8*d* and switching units 6*a*-6*d*, the refrigerant circuit of the air conditioner 1, when its operation is stopped, provides a state shown in FIG. 4.

CPU 110*a* is measuring the passage time from the stop of all compressors 21*a*-21*d* and, when the passage time reaches a given time (an hour) or more, CPU 110*a* transmits a signal containing this information (which is hereinafter described as a passage time signal) to the indoor units 8*a*-8*d* through the communication unit 130*a*.

After the passage time after the stop of all compressors 21*a*-21*d* exceeds the given time, on receiving a heating operation start instruction from a user at 8:00 next day, CPU 810*a* of the indoor unit 8*a* checks whether, while stopping, it has received the passage time signal from CPU 110*a* of the outdoor unit 2*a* through the communication unit 830*a* or not. In this embodiment, since the passage time (an hour) from the stop of all compressors 21*a*-21*d* is a given time or more, the passage time signal has been received.

When the passage time from the stop of all compressors 21*a*-21*d* is a given time or more, the pressure difference between the two ends of the first opening/closing device 61*a* of the switching unit 6*a* is a given value or less. Therefore, even when the first opening/closing device 61*a* is opened and a heating operation is started immediately, no noises are generated in the switching unit 6*a*. Accordingly, CPU 810*a*, on receiving the user's operation start instruction, does not execute the processing for the pressure equalizing control but immediately prepares to start a heating operation (which will be described next).

CPU 810*a*, while referring to the item of the normal time in the heating operation of the switching unit operation table 200 stored in the memory 820*a*, opens the first opening/closing device 61*a* of the corresponding switching unit 6*a* to thereby allow a refrigerant to flow in the first branch pipe 91*a* and also opens the third opening/closing device 63*a* to allow a refrigerant to flow in the third branch pipe 93*a*. CPU 810*a* also closes the second opening/closing device 62*a* to prevent a refrigerant from flowing in the second branch pipe 92*a* and closes the fourth opening/closing device 64*a* to prevent a refrigerant from flowing in the fourth branch pipes 94*a*, 94*b*. CPU 810*a* further opens the indoor expansion valve 82*a* at an opening angle corresponding to a required heating capacity (that is, provides the state of the refrigerant circuit of the indoor unit 8*a* and switching unit 6*a* shown in FIG. 1).

After completion of the start preparation for a heating operation, CPU 810*a* transmits an operation start signal to the indoor unit 2*a* through the communication unit 830*a* and also starts the indoor fan 85*a* such that it can be rotated at a given rotation number.

On receiving the operation start signal from the indoor unit 8*a* through the communication 130*a*, CPU 110*a* opens the outdoor expansion valve 43*a* at a given opening angle corresponding to an operation capacity required and starts the compressor 21*a* and outdoor fan 24*a* such that they can be rotated at a given rotation number. Also, CPU 110*a* determines the number of outdoor units to be operated according to an operation capacity required by the indoor unit 8*a*.

As described above, when the passage time from the stop of all compressors 21*a*-21*c* is a given time or more, CPU 810*a*-810*d* of the indoor units 8*a*-8*d* starting their operations, while referring to the item of the normal time of the switching unit operation table 200, operate the respective opening/closing devices of the corresponding switching units 6*a*-6*d* to thereby start an air conditioning operation immediately. Therefore, without performing unnecessary pressure equalizing control, the time necessary for the operation start of the indoor units 8*a*-8*d* can be shortened, thereby preventing the comfort of the user from being impaired.

[Where the passage time from the stop of all compressors 21*a*-21*c* does not reach a given time or more]

Similarly to the case where the passage time from the stop of all compressors 21*a*-21*c* is a given time or more, the air conditioner 1 is operating in a heating-based operation with the refrigerant circuit shown in FIG. 1. For example, a stop time for stopping the indoor units 8*a*-8*d* all together is timer-set for 21:00 by a user and, according to a user's operation start instruction, the indoor unit 8*a* starts a heating operation at 21:30. CPU 110*a*, at 21:00, instructs other outdoor units 2*b*, 2*c* and indoor units 8*a*-8*d* and, by operating the various valves of the outdoor units 2*a*-2*c*, indoor units 8*a*-8*d* and switching units 6*a*-6*d*, the refrigerant circuit of the stopping air conditioner 1 provides a state shown in FIG. 4.

CPU 110*a* is measuring the passage time from the stop of all compressors 21*a*-21*d*. Before the passage time from the stop of all compressors 21*a*-21*d* reaches a given time (an hour), at 21:30, CPU 810*a* of the indoor unit 8*a*, on receiving a heating operation start instruction from a user, checks whether, while stopping, it has received the passage time signal from CPU 110*a* of the outdoor unit 2*a* through the communication unit 830*a* or not. In this embodiment, the passage time (30 minutes) from the stop of all compressors 21*a*-21*d* has not reached a given time thus CPU 110*a* has not transmitted the passage time signal.

When the passage time from the stop of all compressors 21*a*-21*d* is not a given time or more, there is a fear that the pressure difference between the two ends of the first opening/closing device 61*a* of the corresponding switching unit 6*a* cannot be a given value or less. In this state, when the first opening/closing device 61*a* is opened and a heating operation is started immediately, there is a fear that noises can be generated in the switching unit 6*a*. Therefore, CPU 810*a*, on receiving a user's operation start instruction, executes the processing of the pressure equalizing control in the switching unit 6*a* to be described next and, thereafter, prepares to start a heating operation.

CPU 810*a*, while referring to the pressure increase item of the heating operation of the switching unit operation table 200 stored in the memory 820*a*, closes the first, second and fourth opening/closing devices 61*a*, 62*a* and 64*a* of the corresponding switching unit 6*a* to thereby prevent a refrigerant from flowing in the first and second branch pipes 91*a*, 92*a*, 94*a* and opens the third opening/closing device 93*a* to allow a refrigerant to flow only in the third branch pipe 93*a*.

Under the above operation of the opening/closing devices of the switching unit 6*a*, the switching unit 6*a* when performing the pressure increase control provides a state shown in FIG. 5. Here, in FIG. 5, the states of the outdoor units 2*a*-2*c*, indoor units 8*b*-8*d* and switching units 6*b*-6*d*, which are stopping, are the same as those shown in FIG. 4.

CPU 810*a* measures a control time having passed since the start of the pressure increase control and, when the control time is a uniform pressure time (for example, ten minutes) or more, stops the pressure increase control and prepares to start a heating operation. CPU 810*a*, while referring to the normal time item of the heating operation of the switching unit operation table 200 stored in the memory 820*a*, opens the first opening/closing device 61*a* of the corresponding switching unit 6*a* to thereby allow a refrigerant to flow in the first branch pipe 91*a*, and opens the third opening/closing device 63*a* to thereby allow a refrigerant to flow in the third branch pipe 93*a*. CPU 810*a* closes the second opening/closing device 62*a* to thereby prevent a refrigerant from flowing in the second branch pipe 92*a* and also closes the fourth opening/closing device 64*a* to thereby prevent a refrigerant from flowing in the fourth branch pipes 94*a*, 94*b*. Also, CPU 810*a* opens the indoor expansion valve 82*a* at an opening angle corresponding to a required heating capacity (that is, it provides the state of the refrigerant circuit of the indoor unit 8*a* and switching unit 6*a* shown in FIG. 1).

When having completed the start preparation for the heating operation, CPU 810*a* transmits an operation start signal through the communication unit 830*a* to the outdoor unit 2*a* and also starts the indoor fan 85*a* such that it can be rotated at a given rotation number.

On receiving the operation start signal from the indoor unit 8*a* through the communication unit 830*a*, CPU 110*a* opens the outdoor expansion valve 43*a* at an opening angle corresponding to a required operation capacity and starts the compressor 21*a* and indoor fan 24*a* such that they can be rotated at their given rotation numbers. Also, CPU 110*a* determines the number of outdoor units to be operated according to an operation capacity required by the indoor unit 8*a*.

As described above, when the passage time from the stop of all compressors 21*a*-21*d* has not reached a given time or more, CPU 810*a*-810*d* of the indoor units 8*a*-8*d* which are going to start their operations, while referring to the items of the "pressure increase time "pressure reduction time" of the switching unit operation table 200, execute the processing of the pressure equalizing control in their corresponding switching units 6*a*-6*d*, thereby being able to reduce the generation of noises caused by the pressure difference between the two ends of the first and second opening/closing devices 61*a*, 61*b* and 62*c*, 62*d*.

Here, in the case that the passage time from the stop of all compressors 21*a*-21*d* has not reached a given time or more, when, while the switching units 6*a*-6*d* are executing the processing of the pressure equalizing control according to an operation start instruction given in any one of the indoor units 8*a*-8*d* by a user, the passage time from the stop of all compressors 21*a*-21*d* reaches a given time, CPU 110*a* transmits a passage time signal to the indoor units 8*a*-8*d* through the communication unit 130*a*, and CPU 810*a*-810*d* of the indoor units 8*a*-8*d* having received the passage time signal through the communication units 830*a*-830*d* stop the currently executing the processing of the pressure equalizing control and start operation preparations. When the passage time from the stop of all compressors 21*a*-21*d* reaches, the pressure difference between the two ends of the first opening/closing devices 61*a*, 61*b* or the pressure difference between the two ends of the second opening/closing devices 62*a*, 62*b* is a given value or less and, therefore, after passage of the given time, it is not necessary to execute the processing of the pressure equalizing control. When the given time passes during the execution of the processing of the pressure equalizing control, by starting the operations of the indoor units 8*a*-8*d* immediately, it is possible to prevent the delay of the operation start of the indoor units 8*a*-8*d* caused by executing the unnecessary processing of the pressure equalizing control.

Figure 6A:
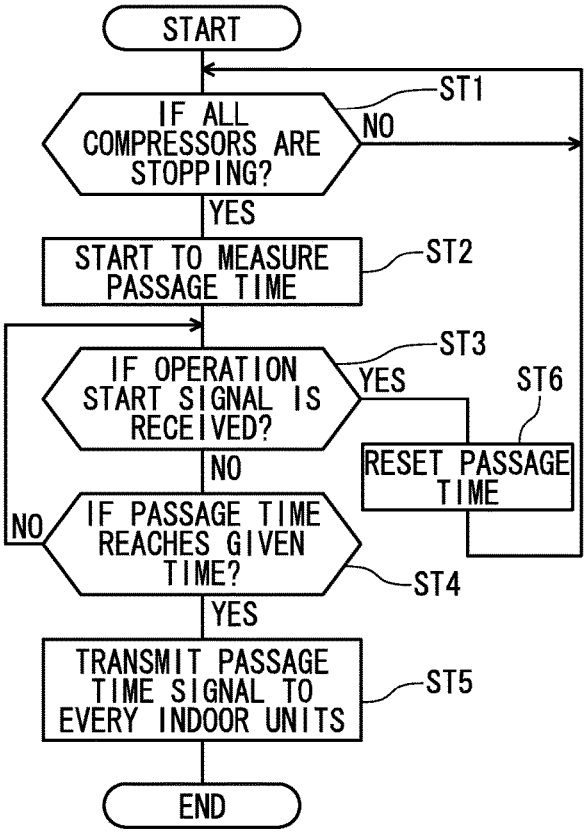
FIG. 6A is a flow chart of the operation of the outdoor units.
Figure 6B:
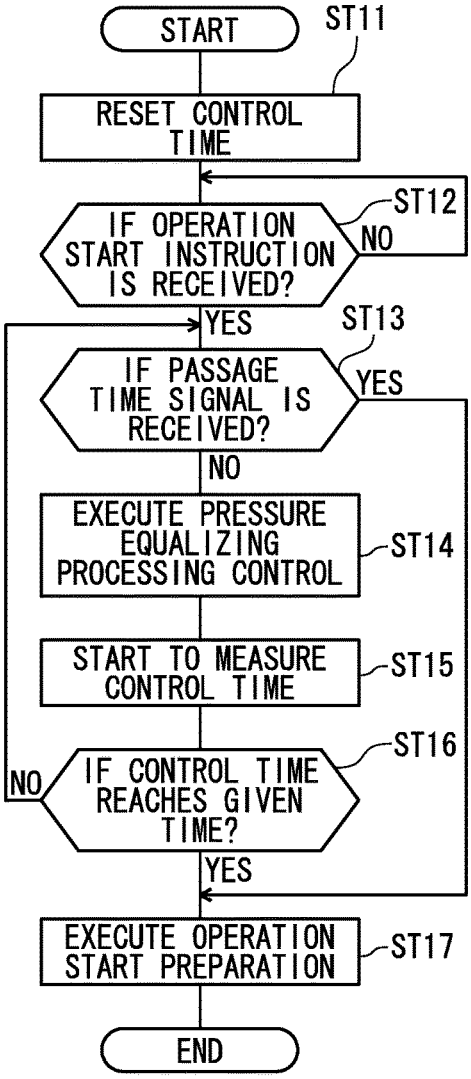
FIG. 6B is a flow chart of the operation of the indoor units.

Next, using a flow charts shown in FIGS. 6A and 6B, description will be given of the flow of processings to be executed by the air conditioner 1 of this embodiment. The flow charts of FIGS. 6A and 6B show the flow of processings to be executed when starting the operation of the air conditioner 1 from a state where all compressors 21*a*-21*d* are stopping. FIG. 6A shows the flow of processings to be executed when CPU 110*a* of the outdoor unit 2*a* serving as a parent unit measures the time while all compressors 21*a*-21*d* are stopping, and FIG. 6B shows the flow of processings to be executed when CPU 810*a*-810*d* of the indoor units 8*a*-8*d* start operation preparations. In either flow chart, "ST" designates a step and a numeral following "ST" a step number. Here, in FIGS. 6A and 6B, description is given mainly of processings relating to the embodiment, while omitting the description of the flow of ordinary processings relating to the air conditioning operation, for example, the control of a refrigerant circuit corresponding to operation conditions such as set temperatures and air amounts specified by a user.

Firstly, using FIG. 6A, description will be given of processings to be executed by CPU 110*a*. While the air conditioner 1 is executing an air conditioning operation, CPU 110*a* checks whether all compressors 21*a*-21*c* have stopped or not (ST1). When not (ST1—No), CPU 110*a* returns the processing to ST1.

When all compressors 21*a*-21*c* have stopped (ST1—Yes), CPU 110*a* starts to measure the passage time from the stop of all compressors 21*a*-21*c* (ST2). Next, CPU 110*a* checks whether it has received an operation start signal from the indoor units 8*a*-8*d* or not (ST3).

When it has received the operation start signal (ST3—Yes), CPU 110 stops the passage time measurement to reset the passage time (ST6) and returns the processing to ST1. When not (ST3—No), CPU 110*a* checks whether the passage time from the stop of all compressors 21*a*-21*d* reaches a given time or not (ST4).

When not (ST4—No), CPU 110*a* returns the processing to ST3. When it has reached the given time (ST4—Yes), CPU 110*a* transmits passage time signals to the indoor units 8*a*-8*d* (ST5) and ends the processing.

Next, using FIG. 6B, description will be given of processings to be executed by CPUs 810*a*-810*d*. CPUs 810*a*-810*d* reset the control time which is the time used to execute the uniform pressure processing control and is measured in ST 15 to be described below (ST11). Next, CPUs 810*a*-810*d* check whether the operation start instruction of the air conditioner 1 according to the setting of the timer or from a user using remote control has been given or not (ST12). When not (ST12—No), CPUs 810*a*-810*d* return the processings to ST12.

When the operation start instruction has been given (ST12—Yes), CPUs 810*a*-810*d* check whether they have received the passage time signals from the outdoor unit 2*a* or not (ST13). When they have received (ST13—Yes), CPUs 810*a*-810*d* advance the processings to ST17. When not (ST13—No), CPUs 810*a*-810*d* execute the processing of the pressure equalizing control in their corresponding switching units 6*a*-6*d* (ST14).

Next, CPUs 810*a*-810*d* start the control time measurement (ST15) and check whether the control time has reached a given time or not (ST16). When not (ST—No), CPUs 810*a*-810*d* return the processing to ST13. Here, in the case that they receive the passage time signals when they return the processing to ST13 (ST13—Yes), CPUs 810*a*-810*d* stop the pressure equalizing control being executed in ST14 and advance the processing to ST17.

When the control time has reached the given time (ST16—Yes), CPUs 810*a*-810*d* execute operation start preparation (ST17). After then, CPUs 810*a*-810*d* notify the outdoor unit 2*a* of the completion of the operation start preparation, and end the processing.

As described above, the air conditioner of the above embodiments, when the passage time from the stop of all compressors is a given time or more, does not execute the processing of the pressure equalizing control. Also, when, during the execution of the processing of the pressure equalizing control, the passage time from the stop of all compressors reaches the given time, the air conditioner stops the processing of the pressure equalizing control. Therefore, since, when starting the operation of the indoor unit while all compressors are stopping, an unnecessary processing of the pressure equalizing control is not executed, the time necessary before starting the operation of the indoor unit can be shortened, thereby preventing the comfort of a user from being impaired.

What is claimed is:

1. An air conditioner comprising:

a plurality of outdoor units each including a compressor, an outdoor heat exchanger and open-air temperature detectors for detecting the temperature of the open-air;

a plurality of indoor units each including an indoor heat exchanger and indoor unit pressure reducing units; and a plurality of switching units provided correspondingly to the plurality of indoor units for switching the direction of the flow of a refrigerant in the indoor heat exchangers, the plurality of outdoor units and the plurality of switching units being connected together by a high pressure gas pipe and a low pressure gas pipe, the plurality of indoor units being connected to the at least one outdoor unit by a liquid pipe, the mutually corresponding plurality of indoor units and plurality of switching units being connected together by refrigerant pipes, wherein each of the plurality of switching units includes pressure equalizing units which, according to an instruction from the corresponding indoor unit, equalize a pressure by increasing or reducing the refrigerant pressure of the indoor heat exchanger provided in the corresponding indoor unit, wherein at least one of the plurality of outdoor units is configured to, when all of the compressors have been stopped for a predetermined amount of time, send an indication of a passage of the predetermined amount of time to each of the plurality of indoor units, wherein each of the plurality of indoor units is configured to instruct the corresponding switching unit to equalize the pressure by connecting the high pressure gas pipe and the low pressure gas pipe through a bypass system comprised in the corresponding switching unit on a condition that the indoor unit has not received a passage time signal indicating a passage of a time in which all of the compressors are stopped, wherein each of the plurality of indoor units is configured not to instruct the corresponding switching unit to equalize the pressure by connecting the high pressure gas pipe and the low pressure gas pipe through the bypass system on a condition that the indoor unit has received the passage time signal, and wherein the predetermined amount of time is an amount of time for a pressure difference between the high pressure gas pipe and the low pressure gas pipe to reduce down to prevent the generation of noises caused by the refrigerant gushing.

2. The air conditioner according to claim 1, wherein, in the case that at least one indoor unit receives the passage time signal indicating the passage of the predetermined amount of time after instructing the corresponding switching unit to equalize the pressure, the at least one indoor unit instructs the corresponding switching unit to stop equalizing the pressure.

3. The air conditioner according to claim 1, wherein when all of the compressors are stopped, the high pressure gas pipe and the low pressure gas pipe are connected through a bypass system comprised in each of the switching units, such that when the heating/cooling operation is started after a given time or more during which the compressors have been stopped, the pressure equalizing unit is not operated.

4. The air conditioner according to claim 1, wherein the passage time signal indicates a passage of a time necessary for a pressure difference between the high pressure gas pipe and the low pressure gas pipe to reduce down to a given value or lower.

* * * * *